US011060212B2

(12) United States Patent
Turner et al.

(10) Patent No.: US 11,060,212 B2
(45) Date of Patent: Jul. 13, 2021

(54) TEXTILES AND GARMENTS FORMED USING YARNS SPACE-TREATED WITH FUNCTIONAL FINISHES

(71) Applicant: NIKE, Inc., Beaverton, OR (US)

(72) Inventors: David Turner, Portland, OR (US); Carmen L. Zolman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/720,611

(22) Filed: Sep. 29, 2017

(65) Prior Publication Data

US 2018/0094365 A1 Apr. 5, 2018

Related U.S. Application Data

(60) Provisional application No. 62/403,853, filed on Oct. 4, 2016.

(51) Int. Cl.
*D02J 1/18* (2006.01)
*D02G 3/34* (2006.01)
(Continued)

(52) U.S. Cl.
CPC ..... *D02J 1/18* (2013.01); *D02G 1/002* (2013.01); *D02G 3/34* (2013.01); *D02G 3/346* (2013.01); *D03D 3/06* (2013.01); *D03D 15/00* (2013.01); *D04B 1/12* (2013.01); *D04B 1/246* (2013.01); *D06B 11/00* (2013.01); *D06B 11/0009* (2013.01); *D06B 11/0086* (2013.01)

(58) Field of Classification Search
CPC ..... A01N 37/46; A01N 57/16; A01N 63/04; A61P 1/00; A61P 1/16; A61P 25/00; A61P 25/08; A61P 31/10; A61P 35/00; A61P 3/00; A61P 7/04; A61P 7/10; C07K 14/38; C07K 16/14; C07K 2317/34; C12N 15/113; C12N 15/8218; C12N 15/8282; C12N 2310/14; D02G 1/002; D02G 3/34; D02G 3/346; D02J 1/18; D03D 15/00; D03D 3/06; D04B 1/12; D04B 1/246; D06B 11/00; D06B 11/0009; D06B 11/0086
See application file for complete search history.

(56) References Cited

U.S. PATENT DOCUMENTS 2,145,858 A 2/1939 Borho
3,785,179 A 1/1974 Davis et al.
(Continued)

FOREIGN PATENT DOCUMENTS

CN 1752317 A 3/2006
CN 101909469 A 12/2010
(Continued)

OTHER PUBLICATIONS https://patents.google.com/patent/CN105133350B/en?oq=CN105133350 (Year: 2015).*
(Continued)

*Primary Examiner* — Arti Singh-Pandey
(74) *Attorney, Agent, or Firm* — Shook, Hardy and Bacon LLP

(57) ABSTRACT

Aspects herein are directed to using a space-treating process to apply functional finishes to a yarn and incorporating the treated yarn into a textile and/or a garment to impart engineered functional properties to the textile and/or garment.

15 Claims, 5 Drawing Sheets

(51) Int. Cl.

| | |
|---|---|
| ***D06B 11/00*** | (2006.01) |
| ***D03D 15/00*** | (2021.01) |
| ***D04B 1/12*** | (2006.01) |
| ***D04B 1/24*** | (2006.01) |
| ***D02G 1/00*** | (2006.01) |
| ***D03D 3/06*** | (2006.01) |

(56) References Cited

U.S. PATENT DOCUMENTS

| | | | | |
|---|---|---|---|---|
| 4,316,312 | A | 2/1982 | Vermeer et al. | |
| 4,544,579 | A | 10/1985 | Mullins et al. | |
| 4,663,231 | A * | 5/1987 | Girgis | D01F 11/14 428/375 |
| 4,695,500 | A | 9/1987 | Dyer et al. | |
| 5,491,858 | A | 2/1996 | Massotte et al. | |
| 5,573,844 | A * | 11/1996 | Donovan | B24D 3/28 442/183 |
| 5,733,656 | A * | 3/1998 | Iohara | D01D 5/253 428/397 |
| 6,413,632 | B1 | 7/2002 | Pascoe et al. | |
| 6,497,936 | B1 * | 12/2002 | Desai | D06B 1/00 428/85 |
| 6,526,739 | B2 | 3/2003 | Kutsenko et al. | |
| 7,008,887 | B2 | 3/2006 | Rearick et al. | |
| 7,243,513 | B2 | 7/2007 | Kohlman et al. | |
| 7,674,301 | B2 | 3/2010 | Brown et al. | |
| 8,850,786 | B2 | 10/2014 | Tung et al. | |
| 2002/0064639 | A1 | 5/2002 | Rearick et al. | |
| 2002/0066145 | A1 | 6/2002 | Gupta et al. | |
| 2002/0197396 | A1 | 12/2002 | Haggquist | |
| 2004/0076792 | A1 | 4/2004 | Green et al. | |
| 2005/0022563 | A1 * | 2/2005 | Keller | D04B 21/04 66/194 |
| 2005/0186872 | A1 * | 8/2005 | Wang | B32B 5/02 442/88 |
| 2006/0148356 | A1 * | 7/2006 | Zhang | D04B 1/14 442/310 |
| 2010/0075020 | A1 * | 3/2010 | Reinprecht | D06B 3/04 427/2.31 |
| 2013/0059112 | A1 | 3/2013 | Tam et al. | |

FOREIGN PATENT DOCUMENTS

| | | | |
|---|---|---|---|
| CN | 103917712 | A | 7/2014 |
| CN | 105133350 | A | 12/2015 |
| EP | 2241206 | A1 | 10/2010 |
| GB | 557420 | A | 11/1943 |
| GB | 1444073 | A | 7/1976 |
| WO | 0194687 | A2 | 12/2001 |
| WO | 2005041106 | A2 | 5/2005 |
| WO | 2015088920 | A1 | 6/2015 |

OTHER PUBLICATIONS

Anton, Anthony. "Piece-Dyeing for Style and Performance." Textile Chemist & Colorist & American Dyestuff Reporter 32.3 (2000). https://books.google.com/books?hl=en&lr=&id=KptWAgAAQBAJ&oi=fnd&pg=PA146&dq=related:njinMfP66AgJ:scholar.google.com/&ots=C8gbroejXJ&sig=QBXwLOrACd8ae1Pql5US312sr48#v=onepage&q&f=false.

International Search Report and Written Opinion dated Jan. 4, 2018 in International Patent Application No. PCT/2017/055034, 13 pages.

International Preliminary Report on Patentability dated Apr. 18, 2019 in International Patent Application No. PCT/US2017/055034, 8 pages.

Intention to Grant received for European Patent Application No. 17791225.0, dated Mar. 16, 2021, 7 pages.

* cited by examiner

TEXTILES AND GARMENTS FORMED USING YARNS SPACE-TREATED WITH FUNCTIONAL FINISHES

CROSS-REFERENCE TO RELATED APPLICATIONS

This application having U.S. application Ser. No. 15/720,611, filed Sep. 29, 2017, and entitled "Textiles and Garments Formed Using Yarns Space-Treated with Functional Finishes," claims the benefit of priority of U.S. Prov. App. No. 62/403,853, entitled "Textiles and Garments Formed Using Yarns Space-Treated With Functional Finishes," and filed Oct. 4, 2016. The entirety of the aforementioned application is incorporated by reference herein.

TECHNICAL FIELD

Aspects herein related to textile and garments formed using yarns space-treated with functional finishes.

BACKGROUND

Space-treating yarns has traditionally been used to dye a yarn multiple different colors thereby altering the aesthetic characteristics of textiles and garments formed from the dyed yarn.

BRIEF DESCRIPTION OF THE DRAWINGS

Examples of the present invention are described in detail below with reference to the attached drawing figures, wherein.

DETAILED DESCRIPTION

Figure 1:
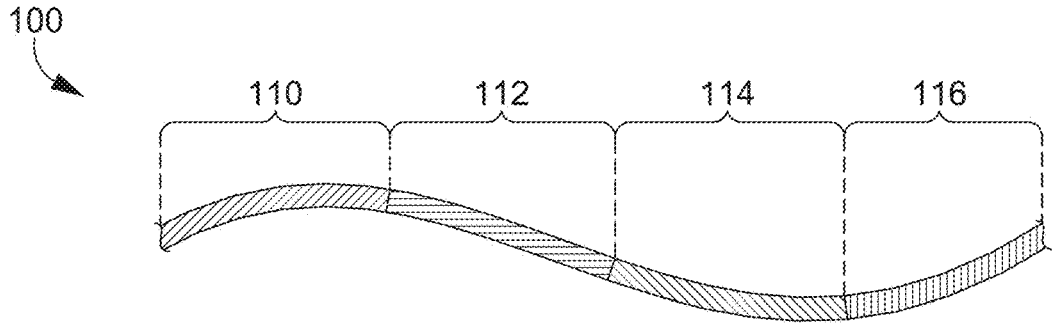
FIG. 1 illustrates an exemplary yarn space-treated with functional finishes in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to textile and garments formed using yarns that have been space-treated with different functional finishes. As used herein, the term "functional finish" may be defined as a finish that alters, changes, or modifies the performance of the yarn to which it is applied and/or contributes to a specific attribute of the yarn without substantially altering the visual appearance of the yarn when it is applied.

Exemplary functional finishes may comprise, for instance, soil and/or stain-release finishes, abrasion-resistant finishes, anti-slip finishes, light-stabilizing finishes, pilling-resistant finishes, water-repellant or hydrophobic finishes such as a durable water repellent finish (DWR finish), moisture-management finishes, porosity-control finishes, water-absorbent or hydrophilic finishes, ultraviolet-absorbent finishes, anti-static finishes, phase-change and temperature regulation finishes, antimicrobial finishes, odor management finishes, electrically conductive finishes, flame-retardant finishes, light-reflecting finishes, burn-out pastes, ultraviolet-reactive inks, and the like. Finishes may also comprise heating and cooling management finishes. As an example, a reflective finish such as a ceramic finish or a metallized vapor may be used such that a resulting yarn is able to reflect heat or light. In another example, a cooling agent such as a menthol, spearmint, or peppermint oil, or other types of cooling chemicals such as an endothermic agent may be applied as a finish to impart cooling properties to the yarn. Another exemplary finish may comprise a color dye that is combined with a functional finish, such as, for example, a DWR finish. As an example, it is often difficult to dye textiles that have been treated with a DWR finish since the DWR may prevent the dye from fully impregnating the yarns in the textile thus resulting in a heather or mottled effect. In exemplary aspects, a colored dye that is combined with a DWR finish may be applied to a yarn using a space-treating process thus allowing for a uniform dispersion of the dye and the DWR finish on the yarn. Textiles produced using such a yarn would generally be evenly dyed and would be substantially impervious to water.

More particularly, aspects herein contemplate using a space-treating process to apply functional finishes to a yarn and incorporating the treated yarn into a textile and/or a garment to impart engineered functional properties to the textile and/or garment. As used throughout this disclosure, the term "space-treating process" is meant to encompass any number of processes known in the art that have been traditionally used to dye a yarn multiple different colors. Traditional exemplary space-treating processes may comprise, for example, a knit-de-knit process where a yarn is first knitted into a tubular fabric and one or more dyes are applied to the tubular fabric. Because the dyes generally do not generally penetrate the yarn crossing points in the knitted textile, once de-knitted the resulting yarn will exhibit short segments (4 mm to 1 cm) of color separated by undyed pieces of yarn.

Another traditional exemplary dye space-treating process may comprise continuous or warp yarn printing where multiple strands of yarn are continuously printed at spaced intervals with different colors. The printing may be accomplished by running the warp yarns through spaced-apart dye baths, using lick rollers or spinning disc applicators, using printing rollers, using dye applicator pads, and the like. The resulting yarn will typically exhibit longer expanses of color in the range of 8 cm to 20 cm.

Continuing, an additional traditional exemplary dye space-treating process may comprise space dyeing in package form. In this method, the yarn may be wound on a cone or other type of bobbin to form a yarn package, and the yarn package is then placed in a receptacle having different feed tanks and injector pumps. The dye is injected at a fixed place on the yarn package at a high pressure to facilitate impregnation of the yarn with the dye. The excess dye is collected through a vacuum. Depending on the placement of the injector pumps, different patterns may be achieved on the yarn package.

Another traditional exemplary dye space-treating process may comprise space dyeing in a hank form. In this process, the yarn is in a hank form and colors are sprayed on the hank at fixed places. In exemplary aspects, the color may be applied under pressure to facilitate impregnation of the yarn with dye, and excess dye may be collected using a vacuum. Parameters such as the length of the colored segments can be controlled.

Aspects herein contemplate modifying the different dye space-treating processes described above to apply one or more functional finishes to a yarn. Because functional finishes may exhibit different properties than dyes such as viscosity, boiling point, surface tension, volatility, and the like, parameters associated with typical dye space-treating processes may need to be modified. For example, modifications may be made to injection times, injection pressures, run times, treatment temperatures, and the like. Physical modifications may be made to, for example, the injector pumps to account for, for example, the viscosity of a particular functional finish. Additional modifications may need to be made to pre-processing and/or post-processing treatments of the yarn based on the properties of the particular functional finish(es) used in the space-treating process. Any and all aspects, and any variation thereof, are contemplated as being within aspects herein.

A characteristic of one or more of these space-treating processes is the ability to apply different functional finishes to different portions of a yarn using different injector pumps, different printing pads, different tanks, and the like. Because of this, after application of the functional finish(es), the yarn may comprise one or more contiguous segments each having a functional finish applied thereto. As used throughout this disclosure, the term "contiguous" means sharing a common border. To put it another way, a single length of yarn may comprise one or more different contiguous segments, each having a functional finish applied thereto. However, it is also contemplated herein that certain yarn segments may not comprise a functional finish. For instance, a first yarn segment may have a functional finish applied thereto, and a second yarn segment that is contiguous with the first yarn segment may not have a functional finish applied thereto. Any and all aspects, and any variation thereof, are contemplated as being within aspects herein.

The length of the individual segments having the functional finish applied thereto may be controlled depending on, for example, the space-treating process used to apply the functional finish. For instance, if a knit-de-knit process is used, the length of the different yarn segments may be short (e.g., 4 mm to 1 cm). However, use of other space-treating processes such as warp yarn printing may produce long yarn segments having a functional finish applied thereto (e.g., between 8 cm and 20 cm). Use of space-treating in hank form or space-treating in package form may enable the creation of segments having variable lengths as well as segments having generally equal lengths.

Continuing, space-treating in package form may, in one aspect, also allow for the creation of a yarn having a gradient of a particular functional finish along the length of the yarn. As an example, when space-treating in package form, the yarn is wound around a cone or bobbin and is then placed in a receptacle having one or more feed tanks and injector pumps. When the functional finish(es) is applied via the injector pumps, a greater impregnation or penetration of the yarn may occur for those yarn segments located near the outside of the cone or bobbin (i.e., near the injector pumps) and a lesser impregnation or penetration of the yarn by the functional finish may occur for those yarn segments located near the interior of the cone or bobbin (i.e., further away from the injector pumps). This differential penetration may be further controlled by modifying the injection pressure used to apply the functional finish and/or by modifying the strength of the vacuum in the receptacle. When the treated yarn is unwound from the cone or bobbin and transferred to a knitting or weaving spool, the yarn pulled from that spool will generally exhibit a gradient of functional finish(es) based on the degree of penetration during the space-treating process. For example, a first length of the yarn, corresponding to a yarn segment located near the outside of the cone or bobbin, may have a greater amount of functional finish, a second contiguous length, corresponding to a yarn segment located near the middle of the cone or bobbin, may exhibit an intermediate amount of functional finish, and a third length contiguous with the second length, corresponding to a yarn segment located near the interior of the cone or bobbin, may exhibit a low amount of functional finish. Thus, a textile or garment knitted or woven using the yarn may exhibit a gradient of the functional finish along, for example, a width of the textile or garment or a length of the textile or garment depending on the knitting/weaving process used to form the textile or garment.

As described, yarns treated with functional finishes using the space-treating processes described above may be incorporated into textiles and garments. In one example, a knit construction may be used to form the textile where the knit construction comprises an interlocking series of loops formed using a yarn space-treated with one or more functional finishes. Assuming that the yarn is treated to have a repeating pattern comprising Functional Finish A-Functional Finish B, a knitted textile incorporating such a yarn would have a staggered pattern of Functional Finish A and a staggered pattern of Functional Finish B. To put it another way, a yarn segment having Functional Finish A would be separated from another yarn segment having Functional Finish A by a yarn segment having Functional Finish B (i.e., yarn segments having Functional Finish A are non-contiguous with each other, and yarn segments having Functional Finish B are non-contiguous with each other). Because of the interlooping nature of the knit construction, the placement of the particular yarns segments having Functional Finish A and/or Functional Finish B will vary along a length or a width of the textile to produce a staggered pattern for each functional finish.

Continuing with respect to this example, depending on the length of the particular segments comprising Functional Finish A and the length of the yarn segments comprising Functional Finish B, a textile formed from the yarn would comprise a certain percentage of yarn segments having Functional Finish A and a remaining percentage of yarn segments having Functional Finish B. As an example, if the yarn segments having Functional Finish A were engineered through the space-treating process to be twice the length of the yarn segments having Functional Finish B, then a textile formed from the yarn would generally comprise 66% Functional Finish A and 33% Functional Finish B. As can be seen, by controlling the length of the yarn segments having a particular functional finish (via, for instance, controlling the parameters associated with the particular space-treating process), the percentage of the yarn comprising a particular functional finish can be controlled. As well, when the yarn is incorporated into a textile, the percentage of the textile comprising a particular functional finish can also be controlled.

Aspects herein further contemplate using space-treated yarns with different functional finishes in weaving constructions. In one instance, the space-treated yarn may be used as, for example, the weft or filling yarn in the weave construction. Like a knit construction, where the functional finish would be present in a staggered pattern in the finished textile, using a space-treated yarn as the weft yarn would produce a similar result. For instance, the placement of the particular yarns segments having a particular functional finish will vary along a length or a width of the woven textile to produce a staggered pattern for the functional finish. Further, as described above, the percentage of the woven textile comprising a particular functional finish can be controlled by varying the length of the yarn segments comprising that particular finish.

It is also contemplated herein that yarns space-treated with functional finishes may be used as warp yarns in a weaving construction. For example, some or all of the warp yarns may comprise yarns that have been space-treated to have one or more functional finishes. The weft yarn used in this construction may, or may not, also be space-treated to have one or more functional finishes. The number of warp yarns having functional finishes, the use of a weft yarn space-treated with functional finishes, the type of functional finishes, and the length of the yarn segments comprising particular functional finishes can all be controlled to engineer a textile having desired functional properties. Any and all aspects, and any variation thereof, are contemplated as being within aspects herein.

By engineering the percentage of a functional finish in a yarn and/or textiles or garments made from that yarn, certain functional advantages may be achieved. For example, traditional constructions may comprise a yarn that has been treated or formed to have a single functional finish along its entire length. Other traditional constructions may comprise an already-formed textile to which a functional finish is applied. In these instances, the portion of the textile that has been treated with the functional finish or that incorporates the yarn that is entirely treated with the same functional finish will comprise 100% of the applied functional finish. In other words, the portion of the textile will exhibit the property of the functional finish without any gradation or modulation. For example, if the yarn has been treated with a DWR finish or the textile has been treated with a DWR finish, the resulting textile will generally be 100% hydrophobic.

Continuing, by engineering the percentage of a functional finish in a yarn, a textile made from that yarn may exhibit a more modulated expression of the applied functional finish. As an example, a yarn may be space-treated such that it comprises 50% yarn segments having a DWR finish, and 50% yarn segments having a hydrophilic finish (although other ratios are contemplated herein). Alternatively, the non-DWR segments may not have a functional finish applied thereto but may be naturally hydrophilic. A textile formed from that yarn would generally be 50% hydrophobic and 50% hydrophilic where both the hydrophobic segments and the hydrophilic segments are staggered across the length and the width of the textile. This may be useful where a wearer desires a garment that generally hides the appearance of sweat to a certain degree but still absorbs some sweat. Moreover, the staggered pattern of the DWR-segments and the non-DWR segments in the textile may help any absorbed moisture to spread out thus avoiding the patterns caused by typical sweat absorption. Other advantages associated with using yarns space-treated with functional finishes will be provided below.

Accordingly, aspects herein provide for a textile comprising a knit construction formed using at least one space-treated yarn having at least a first yarn segment having a first functional finish applied thereto and a second yarn segment contiguous with the first yarn segment, where the second yarn segment does not have the first functional finish applied thereto.

Aspects herein further provide for a garment comprising one or more zones positioned at different areas of the garment, at least one of the one or more zones having a knit construction formed using at least a first space-treated yarn having at least a first yarn segment having a first functional finish applied thereto, and a second yarn segment contiguous with the first yarn segment.

Another aspect provides for a garment comprising at least a first area formed using a knit construction, the knit construction of the first area comprising a first space-treated yarn having at least a first yarn segment having a first functional finish applied thereto and a second yarn segment having a second functional finish applied thereto, the first yarn segment contiguous with the second yarn segment.

In yet another aspect, a textile is provided. The textile comprises a woven construction having a weft yarn comprising at least a first yarn segment having a first functional finish applied thereto and a second yarn segment contiguous with the first yarn segment, where the second yarn segment does not have the first functional finish applied thereto.

A garment is further provided herein comprising one or more zones positioned at different areas of the garment, where at least one of the one or more zones has a woven construction comprising a weft yarn having at least a first yarn segment having a first functional finish applied thereto, and a second yarn segment contiguous with the first yarn segment.

In yet another aspect, a garment is provided comprising at least a first area formed using a woven construction, where the woven construction of the first area comprises a first weft yarn having at least a first yarn segment having a first functional finish applied thereto and a second yarn segment having a second functional finish applied thereto, where the first yarn segment is contiguous with the second yarn segment.

In an additional aspect, a textile is provided where the textile comprises a woven construction having one or more warp yarns comprising at least a first yarn segment having a first functional finish applied thereto and a second yarn segment contiguous with the first yarn segment, where the second yarn segment does not have the first functional finish applied thereto.

Another aspect provides for a textile comprising a knit or woven construction formed using at least one yarn that has been space-treated such that the yarn comprises at least a first yarn segment having a first functional finish applied thereto and a second yarn segment contiguous with the first yarn segment, wherein a location of the first yarn segment having the first functional finish applied thereto is staggered across the length and the width of the textile.

A method of forming a textile is provided comprising providing a yarn having a length, applying at least a first functional finish to a first set of non-contiguous segments of the yarn along the length of the yarn using a space-treating process, and forming the textile using the treated yarn.

Positional terms used throughout this disclosure when describing a garment such as "front," "back," "superior," "inferior," "lateral," "medial" and the like are with respect to the garment being worn as intended by a hypothetical wearer standing in anatomical position. Unless indicated otherwise, terms such as "affixing," "securing," and the like may mean releasably affixing or permanently affixing two or more elements together.

Turning now to FIG. 1, FIG. 1 illustrates a portion of an exemplary yarn 100 that has been space-treated with different functional finishes in accordance with aspects herein. The space-treating processes may comprise any of those described above such as, for example, knit-de-knit, warp yarn printing, space-treating in package form, space-treating in hank form, along with other space-treating processes known in the art and not described herein. In this exemplary aspect, the yarn 100 may comprise contiguous segments 110, 112, 114, and 116. In exemplary aspects, each of the segments 110, 112, 114, and 116 may comprise a functional finish. Further, each of the segments 110, 112, 114, and 116 may comprise a different functional finish as indicated by the different hatching patterns. However, it is also contemplated that two or more of the segments may have the same functional finish. In this respect, the segments having the same functional finish may be contiguous with each other such as segment 110 and segment 112. Or the segments may be separated by an intervening segment having a different functional finish. For instance, segments 110 and 114 may have the same functional finish while segments 112 and 116 have a different functional finish. Further, as stated above, it is contemplated herein that one or more of the segments 110, 112, 114, or 116 may not be treated with a functional finish. Any and all aspects, and any variation thereof, are contemplated as being within aspects herein.

It is contemplated herein that the segments 110, 112, 114, or 116 may have substantially the same length (substantially meaning generally within 5 mm of each other), one or more of the segments 110, 112, 114, or 116 may have a greater length than the remaining segments, or one or more of the segments 110, 112, 114, or 116 may have a smaller length than the remaining segments. Further, it is contemplated herein that segments having the same functional finish applied thereto may comprise substantially the same segment length, although different length segments comprising the same functional finish are contemplated herein.

By adjusting parameters associated with the space-treating process as described above, the length of the segments 110, 112, 114, and 116 can be controlled such that the yarn 100 comprises predetermined percentages of functional finishes. For example, segments 110 and 114 may comprise Functional Finish A, and segments 112 and 116 may comprise Functional Finish B. By adjusting the length of the segments 110 and 114 relative to the length of the segments 112 and 116 the percentage of the yarn 100 comprising Functional Finish A and Functional Finish B may be adjusted. In exemplary scenarios, the percentage of a functional finish on the yarn 100 may be adjusted to be between, for example, 5% to 95%, 15% to 85%, 25% to 75%, 35% to 65%, 45% to 55%, or 50%, although percentage values falling between, above, and/or below these ranges are also contemplated herein.

It is also contemplated herein, that each of the segments 110, 112, 114, and 116 may comprise the same functional finish but in differing degrees of concentration. For example, as described above with respect to space-treating in package form, various parameters for this process can be controlled to achieve variable penetration of the functional finish into the yarn segments based on the location of the particular yarn segment on the cone or bobbin. As an example, penetration of the functional finish into the yarn segments located on the outside of the cone or bobbin may be greater than the penetration of the functional finish into yarn segments located on the inside of the cone or bobbin or intermediate between the outside and the inside of the cone or bobbin. Thus, as an example, yarn segment 110 may exhibit the highest concentration of the functional finish, yarn segment 112 may exhibit the next highest concentration, followed by yarn segment 114 and then yarn segment 116. As will be explained in greater depth below, when the yarn 100 is incorporated into a textile via a knitting or weaving process, a gradient of the functional finish may be achieved across a length and a width of the textile.

Figure 2:
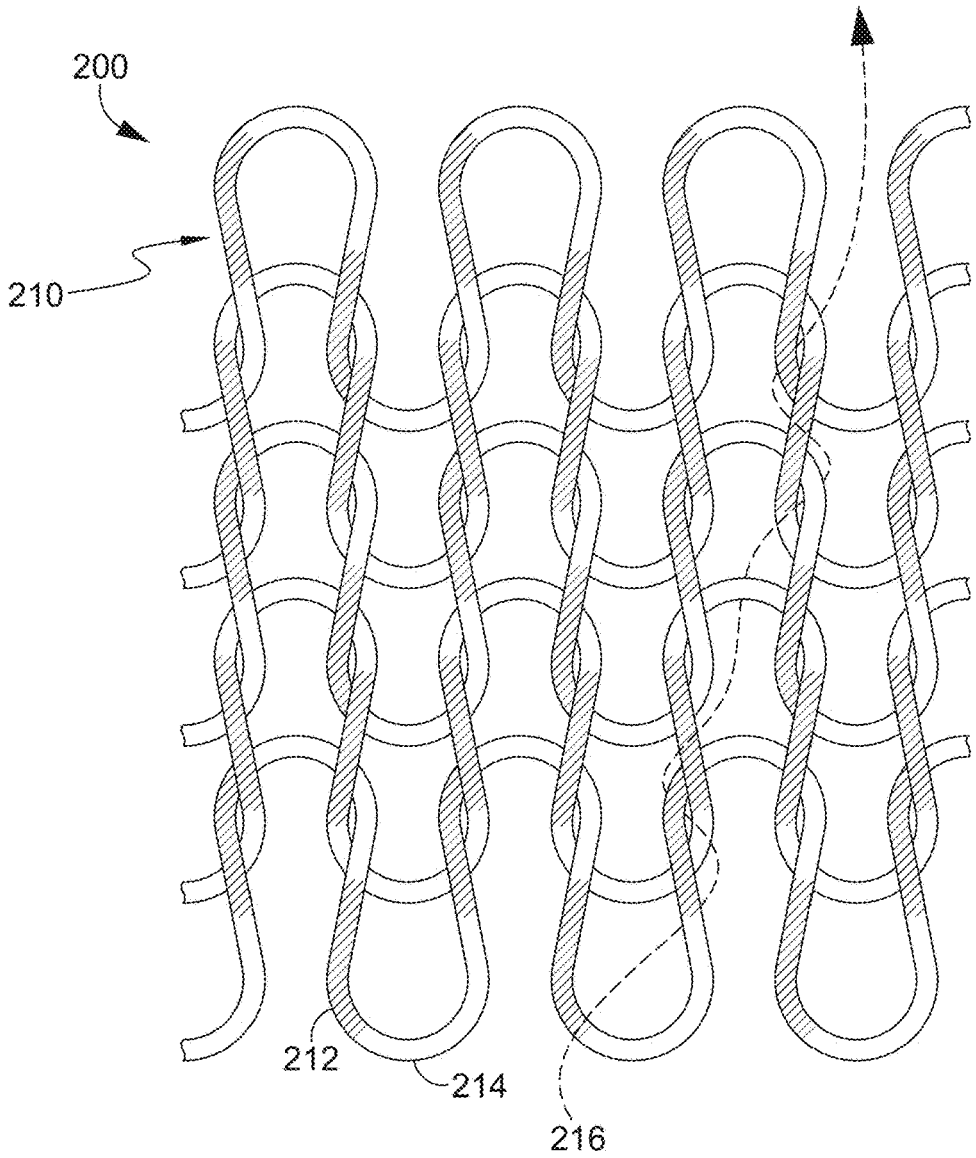
FIG. 2 illustrates an exemplary knitted textile formed using a yarn space-treated with functional finishes in accordance with aspects herein.

FIG. 2 illustrates a portion of a knit textile 200 formed using a yarn 210 that has been space-treated with one or more functional finishes in accordance with aspects herein. For illustrative purposes, the yarn 210 is shown having shaded segments to indicate a first functional finish 212 and non-shaded segments to indicate a second functional finish 214 although it is contemplated herein that the non-shaded segments may also indicate a lack of a functional finish. The segments having the first functional finish 212 are contiguous with the segments having the second functional finish 214 along the length of the yarn 210. In exemplary aspects, it is contemplated herein that the knit textile 200 is formed using only the yarn 210 (i.e., the yarn 210 is not combined with other yarns). For instance, the knit textile 200 may comprise a single knit jersey knitted using the yarn 210 as the sole yarn source. However, it is further contemplated herein that the yarn 210 may be combined with other yarns to form the textile 200. In this aspect, the additional yarns may comprise space-treated yarns or yarns that have not been space-treated. Any and all aspects, and any variation thereof, are contemplated as being within aspects herein.

Because of the interlooping nature of the knit construction, the placement of the first functional finish 212 and the second functional finish 214 varies along the length and the width of the textile 200. In other words, the placement of each of the first functional finish 212 and the second functional finish 214 is staggered across the length and the width of the textile 200. Moreover, depending on the length of the particular yarn segments comprising the first functional finish 212 and the second functional finish 214, the percentage of the respective functional finishes 212 and 214 in the textile 200 may be controlled. The staggered patterning along with the controlled percentages of the functional finishes 212 and 214 may provide certain functional advantages as opposed to forming the textile 200 with a yarn that is treated along its length with just one functional finish and as opposed to forming the textile 200 from an untreated yarn and then applying the functional finish to the textile 200. In both of these instances, the textile 200 would exhibit properties of the functional finish without gradation or modulation.

In exemplary aspects, the first and second functional finishes 212 and 214 may work together to achieve two or more desired properties for the textile 200. For example, it may be desirable for the textile 200 to exhibit properties of two or more functional finishes such as being water-repellant and being able to absorb ultraviolet light. Previous solutions would require the use of two different yarns—one yarn treated with a DWR finish and the second yarn treated with an ultraviolet-absorption finish—thereby potentially creating a heavier-weight textile. Alternatively, the textile itself would have to be treated with both functional finishes after being formed thereby potentially raising manufacturing costs and potentially limiting the number of functional finishes that could be used together due to, for example, an unfavorable reaction occurring between the functional finishes. Using a single yarn having contiguous segments that have been treated with a DWR finish and an ultraviolet-absorption finish respectively enables the creation of a lightweight textile that is generally both water-repellant and provides protection from ultraviolet light.

In another example, using defined percentages of the first and second functional finishes 212 and 214 may facilitate a more modulated or graduated functional property for the textile 200. For instance, it may be desirable for the textile 200 to exhibit a property intermediate between that of each of the functional finishes 212 and 214. In one example, it may be desirable for the textile 200 to absorb some sweat or perspiration produced by a wearer, but not desirable for the textile 200 to absorb all of the sweat or perspiration to avoid the garment incorporating the textile 200 from being saturated with sweat and becoming heavy. This may be achieved by having the first functional finish 212 comprise a DWR finish. The second functional finish 214 may comprise a water-absorption or hydrophilic finish. Or, if the yarn 210 is naturally hydrophilic, the second functional finish 214 may not be applied. In this case, the textile 200 would absorb less sweat or perspiration than it would if the first functional finish 212 was not applied to the yarn 210. Moreover, due to the staggered pattern of the first and second functional finishes 212 and 214, any sweat or water that is absorbed would spread out instead of being concentrated in a defined area.

In yet another example, the staggered patterning of the functional finishes 212 and 214 may be useful in creating channels such as "wicking" channels in the textile 200. In this instance, the first functional finish 212 may comprise a DWR finish and the second functional finish 214 may comprise a water-absorption or hydrophilic finish. As shown in FIG. 2, a "wicking" path or channel 216 may be formed in the textile 200 where the wicking channel 216 comprises substantially adjacent segments of the second functional finish 214 within the textile 200. The wicking channel 216 is further defined or bounded by substantially adjacent segments of the first functional finish 212 (the DWR finish). The wicking channel 216 may be useful for guiding the flow of sweat or perspiration from a first area on the textile 200 to a second area on the textile 200. It is contemplated herein that the textile 200 may comprise multiple wicking channels formed by adjacent segments of the yarn 210 comprising the second functional finish 214.

Other types of channels are contemplated herein. For instance, the second functional finish 214 may comprise an ultraviolet-reactive ink (i.e., an ink that becomes visible upon exposure to ultraviolet light) or a burn-out paste (i.e., a chemical substance that when activated dissolves cellulose-based fibers and leaves behind protein-based fibers). Because of the staggered placement of the second functional finish 214 on the textile 200, activation of, for instance, the ultraviolet-reactive ink or the burn-out past may produce interesting visual patterns.

Figure 3:
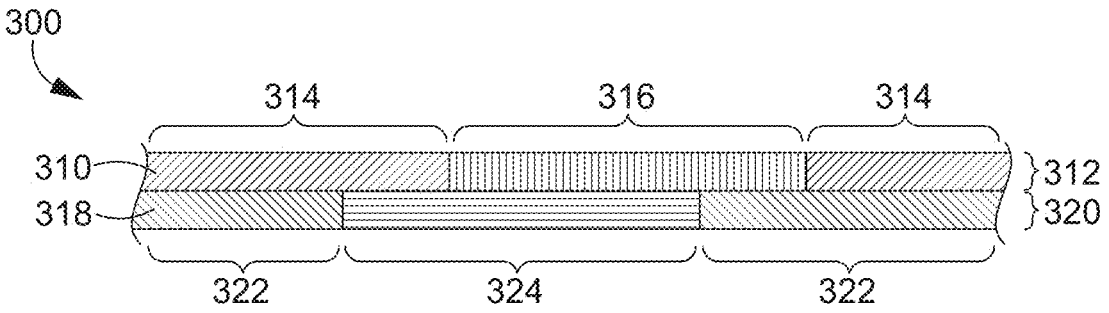
FIG. 3 illustrates a cross-sectional view of a double knit construction formed using two yarns each space-treated with functional finishes in accordance with aspects herein.

Although the textile 200 is described as being a single knit jersey formed using, for example, a single yarn such as the yarn 210, it is also contemplated herein that yarns space-treated with functional finishes may also be used in other knit constructions incorporating two or more yarns such as a double knit construction. An example of this is shown in FIG. 3 which depicts a cross-sectional view of a double knit textile 300 formed using two different yarns each space-treated with functional finishes in accordance with aspects herein. More particularly, the double knit textile 300 comprises a first face 310 formed from a first yarn 312 that has been space-treated to comprise alternating first segments 314 treated with a first functional finish and second segments 316 contiguous with and interposed between the first segments 314. In exemplary aspects, the second segments 316 may be treated with a second functional finish. Continuing, the double knit textile 300 further comprises a second face 318 formed of a second yarn 320 that has been space-treated to comprise alternating third segments 322 treated with a third functional finish and fourth segments 324 contiguous with and interposed between the third segments 322. In exemplary aspects, the fourth segments 324 may be treated with a fourth functional finish. It is contemplated herein that one or more of the segments 314, 316, 322, or 324 may have the same functional finish applied thereto or each segment 314, 316, 322, and 324 may comprise a different functional finish. It is further contemplated herein that one or more of the segments 314, 316, 322, or 324 may not have a functional finish applied thereto. It is also contemplated that a functional finish pattern different than that shown in FIG. 3 may be utilized herein. Any and all aspects, and any variation thereof, are contemplated as being within aspects herein.

When the textile 300 is incorporated into a garment, the first face 310 may comprise an inner-facing surface of the garment and the second face 318 may comprise an outer-facing surface of the garment. In exemplary aspects, the functional finishes applied to the first and second segments 314 and 316 of the yarn 312 may be selected to impart properties to the textile 300 suitable for an inner-facing surface of a garment. For instance, an antimicrobial finish may be applied to the segments 314 and a hydrophilic finish may be applied to the segments 316 of the yarn 312 such that the garment formed from the textile 300 absorbs sweat from a wearer's body while slowing down or inhibiting microbial growth in the skin-contacting inner-facing surface of the garment. Continuing, different functional finishes suitable for an outer-facing surface of the garment may be selected to be applied to the yarn 320 forming the second face 318 of the textile 300. For example, a DWR finish may be applied to the segments 322 and a light-reflecting finish may be applied to the segments 324. The DWR finish may be useful in generally preventing the sweat absorbed by the hydrophilic finish of the segments 316 from showing through on the outer-facing surface of the garment and for providing protection from rain or other types of precipitation. And the light-reflecting finish may be useful for providing enhanced visibility to the wearer when the garment is worn. These examples are illustrative only, and it is contemplated herein that any combination of functional finishes may be applied to the segments 314, 316, 322, and 324 to achieve a desired purpose for the first face 310 of the textile 300 and the second face 318 of the textile 300.

Moreover, it is contemplated herein that the yarn 312 or the yarn 320 may comprise a yarn that has not been space-treated to have two or more functional finishes. For example, the yarn 312 may comprise a DWR-treated yarn (i.e., a yarn that has been treated along its length with a DWR functional finish). The yarn 312 may optionally be knitted to form one or more "DWR" nodes configured to contact a skin surface of a wearer. Continuing, the second yarn 320 may comprise a space-treated yarn having a DWR finish applied to the segments 322 and a hydrophilic finish applied to the segments 324. When incorporated into a garment, the skin-facing DWR-treated yarn 312 may help to limit absorption of sweat into the yarn 312 but may help transport the moisture to the second yarn 320 via, for instance, capillary action. Once transported to the second yarn 320, the hydrophilic finish applied to the segments 324 helps to absorb the sweat, and the DWR finish applied to the segments 322 helps to limit the amount of sweat that shows through on the second face 318. This example is provided for illustrative purposes and other combinations of space-treated yarns and non-space-treated yarns are contemplated herein.

Figure 4:
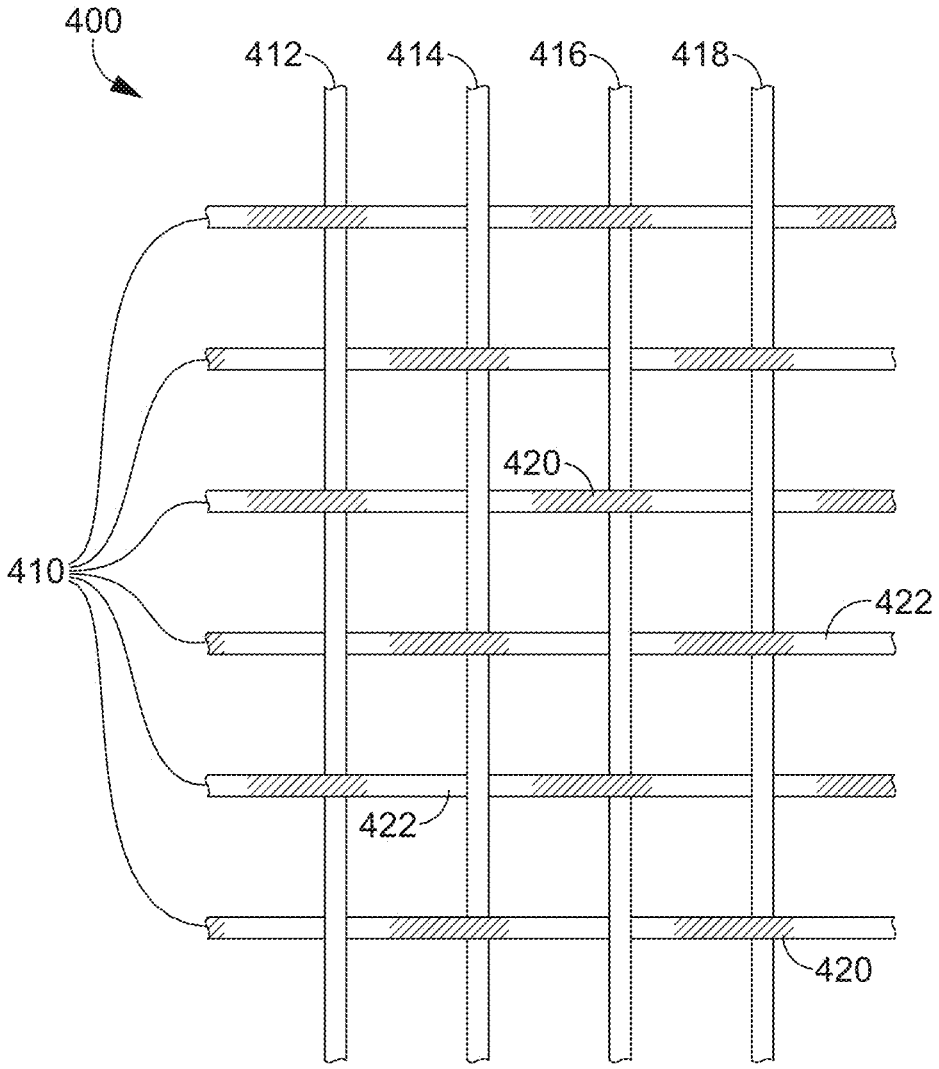
FIG. 4 illustrates an exemplary woven textile formed using a weft yarn space-treated with functional finishes in accordance with aspects herein.

FIG. 4 illustrates an exemplary woven textile 400 having a filling or weft yarn 410 that has been space-treated with one or more functional finishes in accordance with aspects herein. In exemplary aspects, the woven textile 400 comprises a plurality of warp yarns 412, 414, 416, and 418 that are interwoven with the weft yarn 410. The shaded areas on the weft yarn 410 represent a first functional finish 420, and the non-shaded areas of the weft yarn 410 represent a second functional finish 422. Alternatively, the non-shaded areas may represent portions of the yarn 410 that have not been treated with a functional finish. The segments with the first functional finish 420 are contiguous with the segments having the second functional finish 422 along the length of the weft yarn 410.

Because of the interlacing of the weft yarn 410 with the warp yarns 412, 414, 416, and 418, the placement of the first and second functional finishes 420 and 422 along the length and the width of the textile 400 may vary to produce a staggered pattern of the first and second functional finishes 420 and 422. Moreover, by controlling parameters associated with the space-treating process used to apply the functional finishes 420 and 422, the percentage of the functional finishes 420 and 422 in the textile 400 can be engineered to achieve desired functional effects.

Similar to the knit textile 200, the staggered placement of the functional finishes 420 and 422 and the ability to control the percentages of the functional finishes 420 and 422 in the textile 400 by varying the length of the yarn segments may provide certain functional advantages for the woven textile 400 such as, for example, the first and second functional finishes 420 and 422 working together to achieve two or more distinct functional properties for the textile 400, the first and second functional finishes 420 and 422 facilitating a more modulated or graduated functional property for the textile 400, and/or the first and second functional finishes 420 and 422 creating channels such as "wicking" channels in the textile 400. Any and all aspects, and any variation thereof, are contemplated as being within aspects herein.

Figure 5:
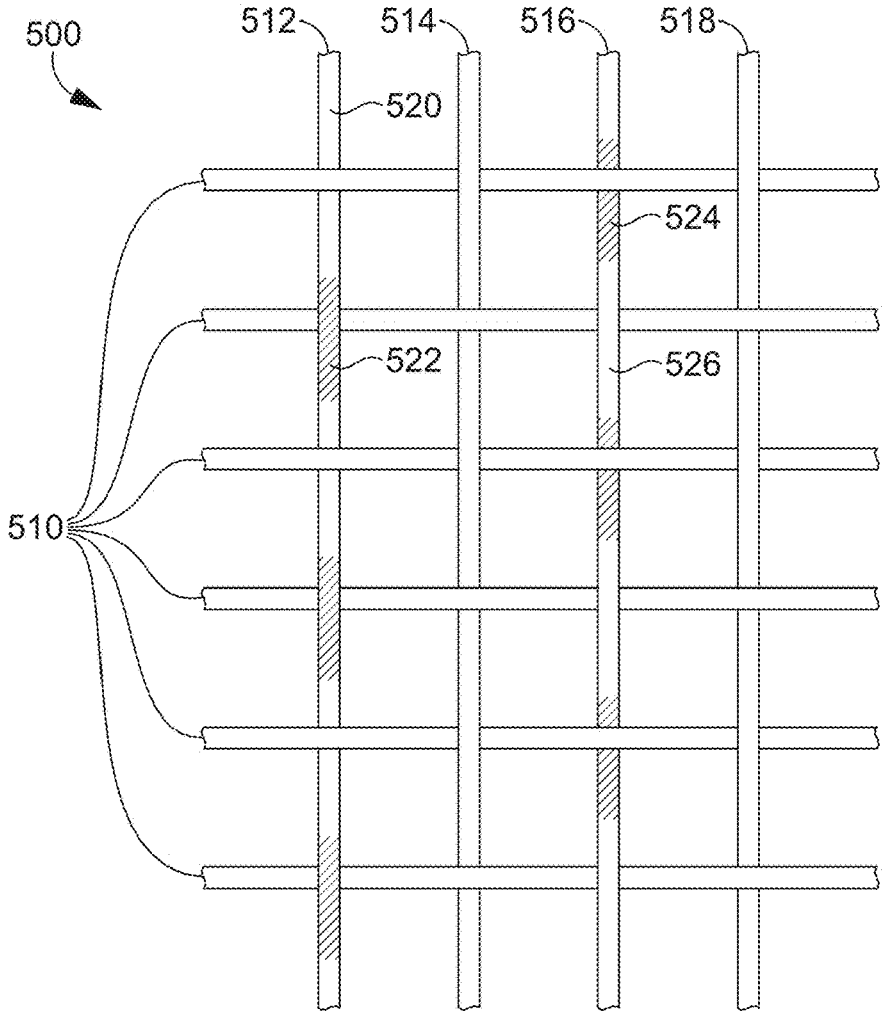
FIG. 5 illustrates an exemplary woven textile formed using one or more warp yarns space-treated with functional finishes in accordance with aspects herein.

FIG. 5 illustrates a woven textile 500 having one or more warp yarns space-treated to have different functional finishes in accordance with aspects herein. The exemplary textile 500 comprise a weft yarn 510 that is interwoven with warp yarn 512, warp yarn 514, warp yarn 516, and warp yarn 518. In exemplary aspects, one or more of the warp yarns 512, 514, 516, and/or 518 may be space-treated to comprise one or more functional finishes. For example, warp yarn 512 is shown as being space-treated so as to have yarn segments comprising a first functional finish 520 and yarn segments comprising a second functional finish 522, where the yarn segments comprising the first functional finish 520 are contiguous with the yarn segments comprising the second functional finish 522. Warp yarn 516 is also shown as being space-treated so as to have yarn segments comprising a third functional finish 524 and a fourth functional finish 526, where the yarn segments comprising the third functional finish 524 are contiguous with the yarn segments comprising the fourth functional finish 526.

Continuing, one or more of the functional finishes 520 and 522 may be the same as one or more of the functional finishes 524 and 526, or one or more of the functional finishes 520 and 522 may be different from one or more of the functional finishes 524 and 526. Further, it is contemplated herein that one or more of the segments on the warp yarns 512 and 516 may not comprise a functional finish. As well, it is contemplated herein, that one or more of the additional warp yarns 514 and 518 may be space-treated to have functional finishes. Moreover, it is contemplated herein that the weft yarn 510 may be space-treated to have one or more functional finishes. Any and all aspects, and any variation thereof, are contemplated as being within aspects herein.

Similar to the woven textile 400, the woven textile 500 may be engineered to have desired functional properties based on, for example, the use of particular functional finishes, the staggered pattern of the functional finishes 520, 522, 524, and 526 across the length and the width of the textile 500, and further based on configuring the warp yarns 512 and 516 to have a targeted percentage of the functional finishes 520, 522, 524, and 526.

Figure 6:
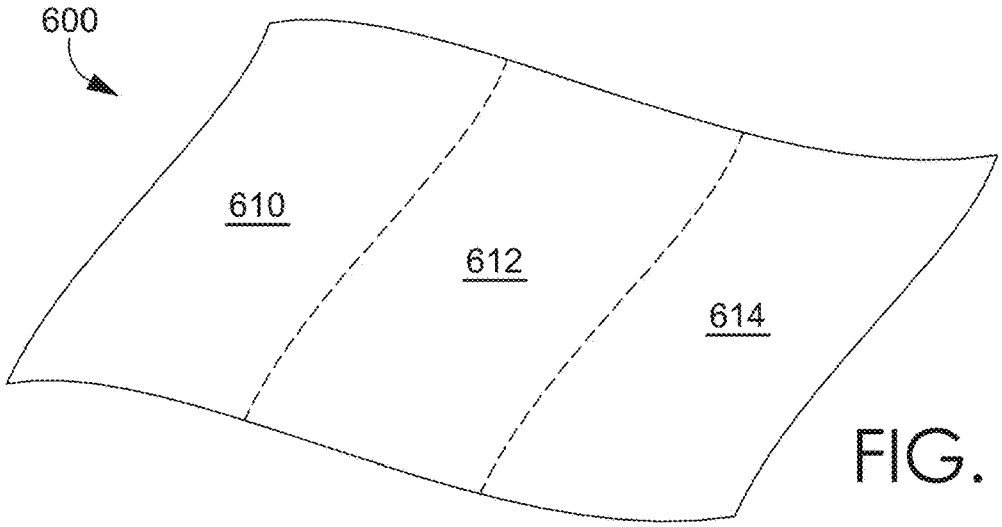
FIG. 6 illustrates an exemplary textile formed using a yarn that has been space-treated to exhibit a gradient of a functional finish in accordance with aspects herein.

Turning now to FIG. 6, FIG. 6 depicts a textile 600 having a gradation of a functional finish across a width of the textile 600 in accordance with aspects herein. The textile 600 may comprise a knitted or woven textile formed using a yarn that has undergone a space-treating process to apply at least one functional finish to the yarn. An exemplary space-treating process may comprise space-treating in package form. As described above, in this process the yarn is wound around a cone or bobbin and placed in a receptacle having one or more injector pumps and fluid tanks. In an exemplary aspect, parameters such as injection pressure and/or the level of vacuum in the receptacle may be altered to achieve a differential penetration of the yarn by the functional finish(es). This may be carried out for each of the injector pumps or for only select injector pumps adapted to apply particular functional finishes. For instance, the injection pressure of an injector pump adapted to apply a particular functional finish may be reduced so that the applied functional finish does not fully penetrate the yarn segments located toward the interior of the cone or bobbin while fully penetrating the yarn segments located toward the exterior of the cone or bobbin. An intermediate level of penetration of the yarn segments located midway between the interior and the exterior of the cone or bobbin may be achieved.

Continuing, when the space-treated yarn is wound on to a knitting or weaving spool, it may be drawn off the spool such that the initial yarn segments exhibit a high level of penetration by the applied functional finish, the next yarn segments exhibit a medium level of penetration of the applied functional finish, and the remaining yarn segments exhibit a low level of penetration by the functional finish. Alternatively, depending on how the yarn is drawn off the knitting or weaving spool, the order may comprise: yarn segments with low level of penetration, yarn segments with medium level of penetration, and yarn segments with high level of penetration.

When knitted or woven into a textile, such as the textile 600, the yarn segments having different levels of penetration by the particular functional finish may be arranged in "zones" such as the zone 610, zone 612, and zone 614 on the textile 600. In exemplary aspects, the zone 610 may comprise yarn segments having a high level of penetration by the particular finish, zone 612 may comprise yarn segment having a medium level of penetration, and zone 614 may comprise yarn segments having a low level of penetration by the particular functional finish. Although the textile 600 is shown having a gradation in the level of the functional finish across its width, it is also possible for the textile 600 to have a gradation in the level of the functional finish across its length depending on the particular knitting or weaving process used and/or how the textile 600 is oriented.

The ability to have a graduated level of a particular functional finish across the width or length of a textile like the textile 600 may be advantageous in garments incorporating such textiles. As an example, a DWR finish may be applied to a yarn as described to achieve a differential penetration of the DWR finish along the length of the yarn. When incorporated into a garment such as a shirt, the zone exhibiting the highest penetration of the DWR finish may be positioned over an upper part of the garment adjacent to the neck opening, and the zone exhibiting the lowest penetration of the DWR finish may be positioned near the bottom of the garment adjacent to the waist opening. When worn, the zone having the highest penetration of the DWR finish would be positioned adjacent to a high sweat producing area of the wearer (i.e., the upper chest and back area of the wearer) thereby helping to minimize absorption of sweat in this area and avoiding unsightly sweat stains. Sweat that is absorbed in this zone (by those yarn segments not comprising the DWR finish or having a different finish such as a hydrophilic finish) may be channeled to other zones of the garment (via, for example, wicking channels such as those described above) having a lower level of penetration of the DWR finish. The sweat can then spread out in these zones, which facilitates faster evaporation of the sweat and faster drying times for the garment. This is just one example, and additional examples involving other functional finishes are contemplated as being with the scope herein. For instance, it is contemplated herein that the particular placement of the different zones 610, 612, and 614 on a garment may be based on the particular sport for which the garment is to be used, and/or whether the resulting garment is to be worn by a male or female. Any and all aspects, and any variation thereof, are contemplated as being within aspects herein.

Figure 7:
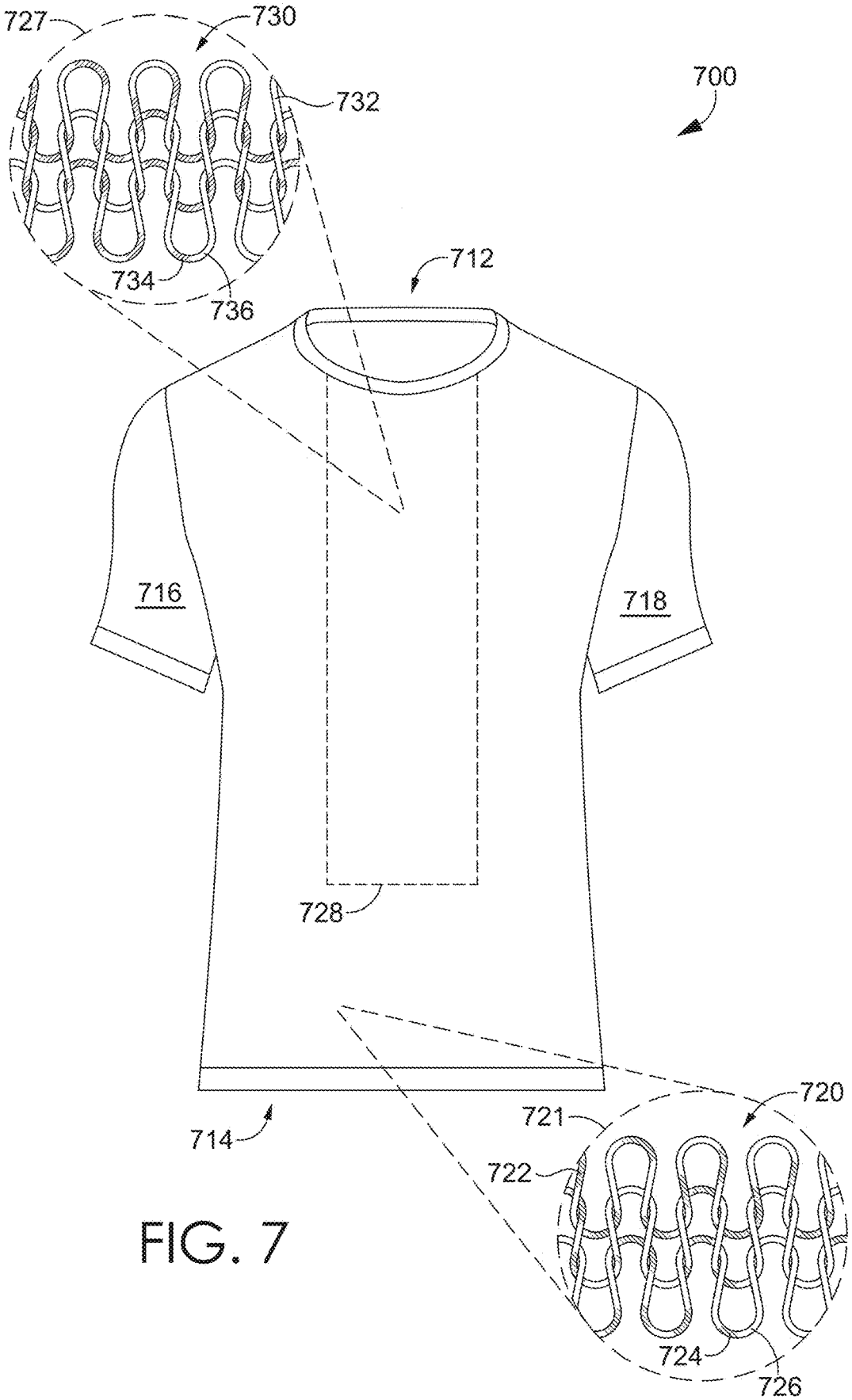
FIG. 7 illustrates an exemplary garment of knitted/woven construction formed using one or more yarns space-treated with functional finishes in accordance with aspects herein.

Turning now to FIG. 7, FIG. 7 illustrates a front view of an exemplary garment 700 formed from a knit textile, such as the knit textile 200 and/or the double knit textile 300, having yarns space-treated with one or more functional finishes in accordance with aspects herein. Although a garment for an upper torso is shown, it is contemplated that the disclosure herein is also applicable to other articles of apparel such as pants, shorts, socks, hats, shoes, protective equipment such as pads, and the like. Any and all aspects, and any variation thereof, are contemplated as being within aspects herein.

With respect to the garment 700, the garment 700 comprises at least a torso portion 710 that is configured to cover a front and back torso of a wearer when the garment 700 is worn. The torso portion 710 defines, at least in part, a neck opening 712, a waist opening 714, and sleeve openings (not shown) from which optional sleeve portions 716 and 718 may extend.

In exemplary aspects, the entirety of the garment 700 or one or more portions thereof, may be formed from a first textile 720 shown in the enlarged view 721, where the first textile 720 is knitted using at least one yarn 722 that has been space-treated with one or more functional finishes. In exemplary aspects, the first textile 720 may comprise the knit textile 200 or the double knit textile 300 described above. The shaded portions of the yarn 722 represent a first functional finish 724, and the unshaded portions of the yarn 722 represent a second functional finish 726. Alternatively, the unshaded portions of the yarn 722 may represent a segment of the yarn 722 that has not been treated with a functional finish. The segments of the yarn 722 having the first functional finish 724 are contiguous with the segments of the yarn 722 having the second functional finish 726.

An exemplary placement of the first textile 720 on the garment 700 is shown in FIG. 7. In this respect, the first textile 720 is shown as generally forming the torso portion 710 except for an area 728 indicated by dashed lines. In exemplary aspects, the area 728 may extend from an area proximate the neck opening 712 (e.g., within, for instance, 0 cm to 20 cm of the neck opening 712) to an area proximate the waist opening 714 (e.g., within, for example, 30 cm to 40 cm of the waist opening 714). Continuing, the area 728 may extend along a central midline of the garment 700 such that it is configured to be generally positioned adjacent to an upper chest area of a wearer when the garment 700 is worn. A similar area may be present on the back of the garment 700 such that the area on the back of the garment 700 is configured to be generally positioned adjacent to an upper back area of a wearer when the garment 700 is worn.

In one exemplary aspect, the area 728 may be formed using a second textile 730 shown in the magnified view 727. The second textile 730 may be knitted using at least one yarn 732 that has been space-treated with one or more functional finishes. In exemplary aspects, the second textile 730 may comprise the knit textile 200 or the double knit textile 300 described above. The shaded portions of the yarn 732 represent a third functional finish 734, and the unshaded portions of the yarn 732 represent a fourth functional finish 736. Alternatively, the unshaded portions of the yarn 732 may represent a segment of the yarn 732 that has not been treated with a functional finish. The segments of the yarn 732 having the third functional finish 734 are contiguous with the segments of the yarn 732 having the fourth functional finish 736.

It is contemplated herein that the second textile 730 may comprise an integral extension of the first textile 720. In other words, the second textile 730 may be integrally knitted from the first textile 720 by, for example, substituting the yarn 732 for the yarn 722 in the area 728. In another example, the second textile 730 may comprise a separate textile piece from the first textile 720, where the second textile 730 is joined to the first textile 720 using affixing technologies known in the art such as stitching, bonding, adhesives, welding, and the like. It is also contemplated herein that the second textile 730 may comprise a different construction—such as a woven construction—from the first textile 720. Any and all aspects, and any variation thereof, are contemplated as being within aspects herein.

In exemplary aspects, the first, second, third, and fourth functional finishes 724, 726, 734, and 736 may be selected to achieve desired functional properties for different areas of the garment 700. As an illustrative example, the area 728 is generally positioned adjacent to a high sweat producing area of the body when the garment 700 is worn. To help avoid having this area of the garment 700 from being overly discolored due to sweat, at least the third functional finish 734 may comprise a DWR finish to impart a hydrophobic characteristic to the area 728 thereby helping to prevent an excessive amount of sweat from being absorbed in this area. However, to facilitate the garment 700 absorbing some sweat in this area to improve wearer comfort, the fourth functional finish 736 may comprise a moisture-management finish or a water-absorbent finish.

An additional functional benefit achieved by using this combination of finishes is the generation of one or more wicking channels in the second textile 730. As described with respect to FIG. 2, the wicking channels may be formed by adjacent segments of the yarn 732 having the moisture-management or water-absorbent finish. The wicking channels may be used to channel sweat from the area 728 to other areas of the garment 700.

With respect to the remaining areas of the torso portion 710 formed from the first textile 720 having the first and second functional finishes 724 and 726, exemplary finishes may comprise, for instance, combinations of a soil and/or stain release finish, an ultraviolet-absorbent finish, an antimicrobial finish, a light-reflecting finish, a DWR finish, a water-absorbent finish, and the like.

The example functional finishes provided above are meant to be illustrative only. The spirit and scope of this disclosure are intended to encompass using space-treated yarns with any number of functional finishes selected to achieve desired functional characteristics of the textile or garment. Moreover, the placement of the first and second textiles 720 and 730 on the garment 700 is also exemplary and other placement patterns are contemplated herein. For instance, the garment 700 may be formed from just the first textile 720 or just the second textile 730, or the garment 700 may be formed from additional textiles having different functional finishes than those described. Further, it is contemplated herein that some or all of the garment 700 may be formed using a single jersey knit construction, or some or all of the garment 700 may be formed using a double-knit construction as described with respect to FIG. 3. As described with respect to FIG. 3, different functional finishes may be used for each face of the double-knit textile to achieve different functional properties for, for example, the outer-facing surface of the garment 700 and the inner-facing surface of the garment 700. Any and all aspects, and any variation thereof, are contemplated as being within aspects herein.

Although not shown, it is also contemplated herein that the garment 700 may be formed of a woven textile(s) such as the textile 400 of FIG. 4, or the textile 500 of FIG. 5. Further, it is contemplated herein that the woven construction may be combined with one or more knit constructions when forming the garment 700. With respect to this aspect, the weft yarn and/or the warp yarns in the woven construction may comprise different functional finishes to achieve desired characteristics of the garment 700. The examples given above for the knit construction are equally applicable when a woven construction is utilized herein. Additionally, it is contemplated herein that the garment 700 may also be formed from the textile 600 of FIG. 6 such that the garment 700 may be divided into different zones having particular functional characteristics. Any and all aspects, and any variation thereof, are contemplated as being within aspects herein.

Figure 8:
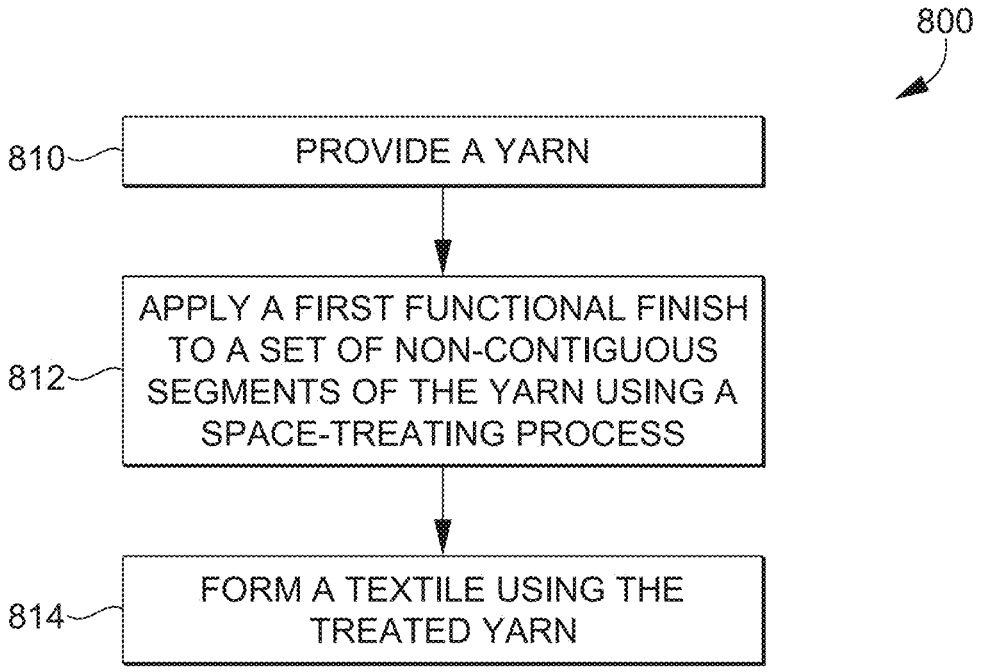
FIG. 8 illustrates a flow diagram of an exemplary method of forming a garment using yarns that have been space-treated with functional finishes in accordance with aspects herein.

Turning now to FIG. 8, a flow diagram is depicted of an exemplary method 800 of forming a textile using yarns that have space-treated with one or more functional finishes. At a step 810, a yarn is provided that has a length. Exemplary types of yarns may include natural yarns such as cotton, wool, silk, and the like, or man-made yarns such as polyester, nylon, and the like.

At a step 812, at least a first functional finish is applied to a first set of non-contiguous segments of the yarn along its length using a space-treating process. Exemplary space-treating processes may comprise, knit-de-knit, warp yarn printing, space-treating in package form, space-treating in hank form, and the like. Parameters associated with the space-treating process may be controlled to achieve, for instance, differential penetration of the functional finish along the yarn length, different length yarn segments comprising the first functional finish, a predefined percentage of the first functional finish on the yarn, and the like.

Continuing, exemplary functional finishes may comprise, for instance, soil and/or stain-release finishes, abrasion-resistant finishes, anti-slip finishes, light-stabilizing finishes, pilling-resistant finishes, water-repellant or hydrophobic finishes such as a durable water repellent finish (DWR finish), moisture-management finishes, porosity-control finishes, water-absorbent or hydrophilic finishes, ultraviolet-absorbent finishes, anti-static finishes, phase-change and temperature regulation finishes, antimicrobial finishes, odor management finishes, electrically conductive finishes, flame-retardant finishes, light-reflecting finishes, burn-out pastes, ultraviolet-reactive inks, heating and cooling management finishes, and the like. After space-treating, the yarn may comprise contiguous segments that form the length of the yarn, where each segment may have a functional finish applied thereto. Alternatively, one or more of the contiguous segments may not comprise a functional finish.

At a step 814, a textile is formed using the space-treated yarn. In exemplary aspects, the textile may comprise a knitted textile such as the knit textile 200 (e.g., a single jersey knit) or the double knit textile 300 (e.g., a double-jersey knit), where the textile is knit using at least the space-treated yarn. In exemplary aspects, the textile may also comprise a woven textile such as the textile 400 or the textile 500. In this construction, the space-treated yarn may form the weft yarn or one of the warp yarns. Additional steps may comprise forming the textile into an article of apparel such as a shirt, a jacket, a pant, a short, a hat, socks, shoes, protective equipment such as pads, and the like. The textile may be incorporated into the article of apparel to impart desired functional properties at the area(s) where the textile is incorporated.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A textile comprising:

a knit construction formed using at least one yarn, wherein after forming the at least one yarn but prior to forming the knit construction, the at least one yarn undergoes a space-treating process such that the at least one yarn includes at least a first yarn segment having a durable water-repellant (DWR) finish applied thereto and a second yarn segment having a hydrophilic finish applied thereto, wherein the first yarn segment and the second yarn segment share a common border along a widthwise direction of the at least one yarn.

2. The textile of claim 1, wherein the at least one yarn further comprises a third yarn segment having a third functional finish applied thereto, wherein the third functional finish is different from one or more of the DWR finish and the hydrophilic finish, and wherein the third yarn segment and the second yarn segment share a common border along the widthwise direction of the at least one yarn.

3. The textile of claim 2, wherein the at least one yarn further comprises a fourth yarn segment having a fourth functional finish applied thereto, wherein the fourth functional finish is different from one or more of the DWR finish, the hydrophilic finish, and the third functional finish, and wherein the fourth yarn segment and the third yarn segment share a common border along the widthwise direction of the at least one yarn.

4. The textile of claim 1, wherein between 25% and 75% of the at least one yarn comprises the DWR finish.

5. The textile of claim 4, wherein between 25% and 75% of the textile comprises the DWR finish.

6. The textile of claim 1, wherein a location of the first yarn segment comprising the DWR finish varies along a length and a width of the textile.

7. The textile of claim 6, wherein a location of the second yarn segment comprising the hydrophilic finish varies along the length and the width of the textile.

8. A garment comprising:

a knit construction formed using at least one yarn, wherein after forming the at least one yarn but prior to forming the knit construction, the at least one yarn undergoes a space-treating process such that the at least one yarn comprises at least a first yarn segment having a durable water-repellant (DWR) finish applied thereto and a second yarn segment having a hydrophilic finish applied thereto, wherein the first yarn segment and the second yarn segment share a common border along a widthwise direction of the at least one yarn, and wherein a location of the first yarn segment and the second yarn segment is staggered across a length and a width of the garment.

9. The garment of claim 8, wherein between 25% and 75% of the at least one yarn comprises the DWR finish.

10. The garment of claim 9, wherein between 25% and 75% of the garment comprises the DWR finish.

11. The garment of claim 8, wherein a length of the first yarn segment is different from a length of the second yarn segment.

12. The garment of claim 8, wherein a length of the first yarn segment is the same as a length of the second yarn segment.

13. A method of forming a textile, the method comprising:

providing a yarn having a length;

applying a durable water-repellant finish to a first set of knit segments of the yarn along the length of the yarn using a space-treating process;

applying a hydrophilic finish to a second set of knit segments of the yarn along the length of the yarn using the space-treating process, wherein a first knit segment of the first set of knit segments shares a common border with a first knit segment of the second set of knit segments along a widthwise direction of the yarn; and forming the textile using the treated yarn.

14. The method of claim 13, wherein the space-treating processes comprises one of knit-de-knit, warp yarn printing, space-treating in package form, or space-treating in hank form.

15. The method of claim 13, wherein a placement of the first set of knit segments comprising the durable water-repellant finish is staggered across a length and a width of the formed textile.

* * * * *